United States Patent [19]

Miller

[11] 4,425,223

[45] Jan. 10, 1984

[54] METHOD FOR MINIMIZING FOULING OF HEAT EXCHANGERS

[75] Inventor: Richard F. Miller, Humble, Tex.

[73] Assignee: Atlantic Richfield Company, Los Angeles, Calif.

[21] Appl. No.: 479,411

[22] Filed: Mar. 28, 1983

[51] Int. Cl.[3] ..... C10G 9/16

[52] U.S. Cl. ..... 208/48 AA; 252/33.2; 252/8.3

[58] Field of Search ..... 208/48 AA; 252/33.2

[56] References Cited

U.S. PATENT DOCUMENTS

| | | | |
|---|---|---|---|
| 3,105,810 | 10/1963 | Miller et al. | 208/48 AA |
| 3,453,124 | 7/1969 | Wurstner | 252/33.2 |
| 3,516,922 | 6/1970 | Anzilotti | 208/47 |
| 3,558,470 | 1/1971 | Gillespie et al. | 208/48 AA |
| 3,645,886 | 2/1972 | Gillespie et al. | 208/48 AA |
| 3,800,002 | 3/1974 | Chikatsu et al. | 208/48 AA |
| 3,920,572 | 11/1975 | King et al. | 208/48 AA |
| 4,024,048 | 5/1977 | Shell et al. | 208/48 AA |
| 4,024,050 | 5/1977 | Shell et al. | 208/48 AA |
| 4,226,700 | 10/1980 | Broom | 208/48 AA |
| 4,264,363 | 4/1981 | Cech | 252/33.2 |

FOREIGN PATENT DOCUMENTS

| | | | |
|---|---|---|---|
| 1488184 | 10/1966 | France | 208/48 AA |
| 985180 | 3/1965 | United Kingdom | 208/48 AA |

*Primary Examiner*—Delbert E. Gantz
*Assistant Examiner*—O. Chaudhuri
*Attorney, Agent, or Firm*—Coleman R. Reap

[57] ABSTRACT

Hydrocarbon process equipment is protected against fouling during processing of high sulfur-containing hydrocarbon feedstocks by incorporating into the hydrocarbon being processed small amounts of a composition comprised of an alkyl ester of a phosphorus acid and a hydrocarbon sulfonic acid.

7 Claims, No Drawings

METHOD FOR MINIMIZING FOULING OF HEAT EXCHANGERS

FIELD OF INVENTION

This invention relates to antifoulants and to a method of inhibiting fouling in high sulfur-containing petroleum or petroleum derivative processing equipment by injecting an antifoulant composition into a feed stream of the material being processed.

BACKGROUND

Fouling of heat transfer surfaces of petroleum processing equipment occurs continuously during the period when petroleum or its derivatives are being processed in the equipment. The fouling is caused by the gradual buildup of a layer of high molecular weight polymeric material resulting from the thermal polymerization of unsaturated materials which are present in the petroleum. As time goes by, fouling continues with the attendant loss of heat transfer until finally the point is reached where it becomes necessary to take the equipment out of service for cleaning. Cleaning is expensive and time consuming, consequently methods of preventing fouling, or at least significantly reducing the rate of fouling, are constantly being sought.

The most economical method of reducing the fouling rate in process heat transfer equipment is to add chemicals which inhibit fouling, called "antifoulants", to the feed stream being processed. Many antifoulants are not satisfactory for use with high sulfur-containing hydrocarbons because of the formation of undesirable side products.

PRIOR ART

U.S. Pat. No. 3,105,810, issued to Miller et al. employs alkyl benzene sulfonic acids and certain of their salts to prevent fouling of metal surfaces and equipment in refinery processes. U.S. Pat. No. 3,261,774, issued to Newkirk et al teaches the use of various N-alkyl amidophosphoric acids as antifoulants. U.S. Pat. No. 3,558,470 discloses the use of mixtures of organophosphite esters and a condensation product of mono- or dicarboxylic acids or anhydrides thereof with polyalkylene polyamines. U.S. Pat. No. 4,024,050, issued to Shell et al discloses the use of organic phosphorus compounds such as phosphate and phosphite esters as refinery equipment antifoulants. U.S. Pat. No. 4,024,051, issued to Shell et al., discloses the use of phosphorus acids or their amine salts as antifoulants in petroleum refinery processes.

It has now been discovered that mixtures of esters of phosphorous acid or phosphoric acid and hydrocarbon sulfonic acids provide outstanding antifoulant protection for petroleum processing equipment in which petroleum or petroleum derivatives having high sulfur content such as high sulfur (sour) crude oils and HDS (hydrogen desulfurizer) unit feedstocks are processed. Thus, because of the synergistic effect of these mixtures it is now possible to provide unexpectedly superior antifouling protection with a mixture of esters of phosphorous or phosphoric acid and hydrocarbon sulfonic acids, such as alkyl benzene sulfonic acids, than can be obtained by the use of members of either of these groups of compounds by themselves.

Accordingly, it is an object of the invention to present new petroleum processing equipment antifoulant compositions. It is another object of the invention to present a method of enhancing the antifouling protection of petroleum processing equipment during the processing of high sulfur-containing feedstocks. These and other objects of the invention are set forth in the following description and examples of the invention.

SUMMARY OF THE INVENTION

The improved antifoulant compositions of the invention are comprised of mixtures of one or more esters of phosphorous and/or phosphoric acid, each alkyl group of which has 1 to 20 carbon atoms, and one or more hydrocarbon sulfonic acids. Preferred mixtures are those comprised of alkyl esters of phosphorous and/or phosphoric acids having 2 to 10 carbon atoms and alkyl benzene sulfonic acids and/or alkylated naphthalene sulfonic acids in which each alkyl group has 4 to 14 carbon atoms. In a preferred embodiment of the invention the antifoulant composition is dissolved in an organic solvent and the resulting solution is continuously injected into a stream of petroleum at a point which is upstream from the equipment which is to be protected.

DETAILED DESCRIPTION OF THE INVENTION

The esters of phosphorous or phosphoric acid used in the invention have the structural formulas

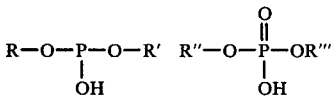

wherein R and R″ are hydrogen or the same or different straight or branched-chain alkyl groups or cycloalkyl groups each having up to about 20 carbon atoms and R′ and R‴ are the same or different straight or branched-chain alkyl groups or cycloalkyl groups each having up to 20 carbon atoms. Although esters of phosphorous or phosphoric acid with alkyl or cycloalkyl groups each having more than about 20 carbon atoms may be useful in the invention it is preferred that compounds containing 20 or fewer carbon atoms in each such group be used in the invention because the latter compounds are commercially available. In preferred embodiments the number of carbon atoms in R and R″, when applicable, and R′ and R‴ is in the range of 2 to 12 and most preferably is in the range of 3 to 10 for alkyl groups and in the range of 6 to 10 for cycloalkyl groups. Mixtures of two or more esters of phosphorous or phosphoric acid can also be advantageously used in the compositions of the invention.

Suitable esters of phosphorous and phosphoric acid include propyl phosphite, butyl phosphite, dihexyl phosphite, butyloctyl phosphite, dipropyl phosphite, hexyloctyl phosphate, decyl phosphate, dihexyl phosphate, octyldodecyl phosphate, etc. Suitable cycloalkyl phosphorus and phosphoric esters include cyclohexyl phosphite, hexylcyclohexyl phosphite, dicyclohexyl phosphite, cyclohexyl phosphate, dicyclohexyl phosphate, octylcyclohexyl phosphate, etc. Preferred phosphorous and phosphoric acid esters include butyl phosphate, dibutyl phosphite, hexyl phosphite, isooctyl phosphite, diisooctyl phosphate, cyclohexyl phosphite, cyclohexyl phosphate, etc. As noted above, two or more of these compounds may be used in combination, if desired.

The hydrocarbon sulfonic acids useful in the invention generally have up to about 50 carbon atoms. They may be straight chain hydrocarbon sulfonic acids or aromatic sulfonic acids. The straight chain hydrocarbon sulfonic acids include saturated aliphatic hydrocarbon sulfonic acids such as alkyl sulfonic acids or unsaturated aliphatic hydrocarbon sulfonic acids, such as alkenyl sulfonic acids. The aromatic sulfonic acids include the alkyl benzene sulfonic acids and the alkylated naphthalene sulfonic acids. The preferred class of hydrocarbon sulfonic acids are the aromatic sulfonic acids, particularly the alkyl benzene sulfonic acids. These are described in more detail in the following paragraphs.

Alkyl benzene sulfonic acids useful in the invention are those having the structural formula

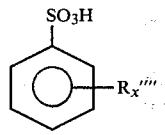

wherein R'''' is an alkyl group having from 1 to 20 or more carbon atoms and x is 1 to 3. The total number of carbon atoms in R'''' may exceed 20 but no particular advantage is derived from the use of such high molecular compounds. The alkyl groups may be straight or branched-chain. Preferred alkyl benzene sulfonic acids those in which the total number of carbon atoms in R is 4 to 12. Mixtures of two or more alkyl benzene sulfonic acids may be used in the invention if desired.

Suitable alkyl benzene sulfonic acids include p-t-butylbenzene sulfonic acid, p-t-amylbenzene sulfonic acid, octylbenzene sulfonic acid and dodecylbenzene sulfonic acid. Preferred alkylbenzene sulfonic acids include p-t-butylbenzene sulfonic acid, dodecylbenzene sulfonic acid, etc.

Alkylated naphthalene sulfonates useful in the invention are those having the structural formula

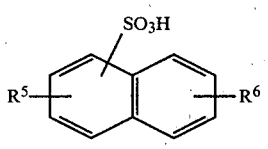

wherein $R^5$ and $R^6$ are the same or different substituents selected from H and alkyl groups and the total number of carbon atoms in each of $R^5$ and $R^6$ may vary from 3 to 20 or more. The total number of carbon atoms in $R^5$ and $R^6$ may exceed 20 but no particular advantage is derived from the use of such high molecular weight compounds. When $R^5$ and/or $R^6$ are alkyl groups they may be straight or branched-chain. Preferred alkyl naphthalene sulfonates are those in which the total number of carbon atoms in each of $R^5$ and $R^6$ in the above formula is 3 to 14. Mixtures of two or more alkyl naphthalene sulfonates may be used in the invention if desired.

Suitable alkylated naphthalene sulfonic acids include n-butyl naphthalene sulfonic acid, t-butyl naphthalene sulfonic acid, di-t-butyl naphthalene sulfonic acid, hexyl naphthalene sulfonic acid, 4,5-didodecyl naphthalene sulfonic acid, 4,decyl-5-octadecyl naphthalene sulfonic acid, etc. Mixtures of two or more different sulfonic acids may be used in the compositions of the invention, if desired.

Some esters of phophorous or phosphoric acid such as isooctyl acid phosphate and some hydrocarbon sulfonic acids such as dodecyl benzene sulfonic acid, are available commercially. Those esters of phosphorous and phosphoric acid and hydrocarbon sulfonic acids which are not commercially available may be prepared by any of the well know techniques. The preparation of these compounds forms no part of the present invention.

The concentration of phosphorus ester to hydrocarbon sulfonic acid in the compositions of the invention is generally in the range of about 10 to 90 weight percent phosphorus ester 90 to 10 weight percent hydrocarbon sulfonic acid, based on the total combined weight of these components. In perferred embodiments the concentrations generally fall in the range of about 25 to 75 weight percent phosphorus ester and 75–25% hydrocarbon sulfonic acid, based on the total combined weight of these components.

The antifoulant compositions of the invention may include other additives, if desired. For example, other antifoulants may be used in combination with the above antifoulants of this invention, or dispersants, corrosion inhibitors, etc. may be combined with the above antifoulant to improve the efficiency of these compositions or to provide additional protection to the process equipment.

The antifoulant compositions of the invention can be introduced into the equipment to be protected by any conventional method. It is generally introduced just upstream of the point of desired application by any suitable means, such as by use of proportionating pump. The antifoulant composition may be added as a concentrate but it is preferable to add it as a solution or a slurry in a liquid diluent which is compatible with the stream being treated. Suitable solvents include kerosene, naphtha, petroleum distillate, the lower alkanes such as hexane, aromatic solvents, such as toluene, etc. The concentration of antifoulant in the solvent is desirably in the range of about 1 to 30 weight percent and preferably about 5 to 20 weight percent based on the total weight of antifoulant and solvent.

The antifoulant is used at the concentration which is effective to provide the desired protection against fouling. It has been determined that amounts of antifoulant in the range of about 0.5 to 1000 ppm based on the weight of the petroleum or petroleum derivative stream being treated afford ample protection against fouling. For most applications the inhibitor is used in amounts in the range of about 1 to 100 ppm.

The following examples will serve to further illustrate the invention. Unless otherwise stated, parts and percentages are on a weight basis.

In the examples the thermal fouling determinations were made using a Jet Fuel Thermal Oxidation Tester marketed by Alcor, Inc. The specifications of this apparatus are set forth in ASTM D3241-74T. In general the apparatus consists of a reservoir to hold the hydrocarbon liquid being tested, an electrically heated tubular heater and a precision stainless steel filter. Tubular conduit connects the reservoir with the heater and the heater with the filter. Pressure gauges are provided for measuring the pressure drop across the filter. A thermocouple and a temperature controller are provided for precise control of the temperature of the liquid passing through the heater.

In operation, a hydrocarbon oil is pumped through the heater, which has adequate heat transfer surface to maintain the heater effluent at a predetermined temperature in the range of about 250° to 900° F. As the hydrocarbon passes through the heater a film of polymeric residue builds up on the inside of the heater. Particles of the residue slough off the surface of the heater tube and are caught in the filter. As the filter clogs up the pressure drop across the filter increases. The fouling rate in the heater is approximated by measuring the rate of pressure build-up across the filter. The test is terminated when the pressure drop reaches a predetermined value. The equipment is dismantled and thoroughly cleaned after each run.

In the following examples antifoulant effectiveness is measured by comparing the time required for the pressure drop of a hydrocarbon stream containing the antifoulant to reach a certain value with the time required for the pressure drop of a stream of the same hydrocarbon but without the antifoulant to reach the same pressure drop value.

EXAMPLE I

Antifoulant effectiveness tests were conducted using hydrogen desulfurizer (HDS) unit feed as the hydrocarbon carrier liquid. The tests were carried out using a hydrocarbon flow rate of about 240 ml per hour with the heat exchanger skin temperature maintained at 600° F. Run 1 was carried out using uninhibited HDS feed, Run 2 was carried out using dodecylbenzene sulfonic acid at a concentration of 25 ppm in the HDS feed, Run 3 was carried out using isooctyl acid phosphate at a concentration of 25 ppm and Run 4 was carried out using a combination of 12.5 ppm dodecyl benzene sulfonic acid and 12.5 ppm isooctyl acid phosphate. Data with respect to thermal fouling tendency is presented as pressure drop across a filter (mm. Hg.), tabulated and presented in Table I.

TABLE I

| Test Time (Minutes) | Pressure drop, mm* | | | |
|---|---|---|---|---|
| | Run 1 (Blank) | Run 2 | Run 3 | Run 4 |
| 0 | 0 | 0 | 0 | 0 |
| 30 | 1 | 18 | 0 | 0 |
| 60 | 2 | 15 | 1 | 0 |
| 90 | 11 | 140 | 3 | 0 |
| 120 | 35 | test stopped | 8 | 0.5 |
| 150 | 120 | | 37 | 0.5 |

*When the pressure drop exceeded 150 mm. Hg. the test was terminated.

As seen from the data presented there was an unexpected synergism exhibited for the combination of dodecyl benzene sulfonic acid and isooctyl acid phosphate (Run 4). In Run 1, the control, the pressure drop after 150 minutes was 120 mm, indicating severe fouling. The Run 2 test had to be terminated because of excessive fouling. The Run 3 test showed fair antifouling activity and the Run 4 test, in which the antifoulant composition of the invention was used, showed only a trace amount of fouling.

EXAMPLE II

The procedure of Example I was repeated except that the heat exchanger skin temperature was maintained at 700° F. Run 1 was carried out using uninhibited HDS unit feed, Run 2 was carried out using isooctyl acid phosphate and Run 3 was carried out using the blend used in Run 4 of Example I. The antifoulants in Runs 2 and 3 were again used at 25 ppm. The test using dodecyl benzene sulfonic acid was not repeated because of the premature fouling observed in Example I. Data was tabulated and presented in Table 2 as pressure drop (mm. Hg.)

TABLE II

| Test Time (Minutes) | Pressure Drop, mm | | |
|---|---|---|---|
| | Run 1 (Blank) | Run 2 | Run 3 |
| 0 | 0 | 0 | 0 |
| 5 | 1 | 0.5 | 0.5 |
| 10 | 7 | 4 | 1 |
| 15 | 38 | 20 | 3 |
| 20 | 161 | 75 | 7.5 |
| 25 | — | 145 | 16 |
| 30 | — | 188 | 30 |
| 35 | — | — | 42.5 |

This example shows the utility of the antifoulant compositions of the invention at high temperatures. In this example the control (Run 1) and the Run using isooctyl acid phosphate above had to be terminated after 25 and 30 minutes, respectively, due to excessive fouling. The fouling rate in the Run 3 experiment, in which the antifoulant composition of the invention was used, was much lower than that of comparative Runs 1 and 2.

EXAMPLE III

To further demonstrate the usefulness of this invention, a sulfur-containing crude oil (sour crude) was employed in thermal fouling tests wherein the heat exchanger temperature was maintained at 650° F. Run 1 was carried out employing uninhibited crude oil and Run 2 was carried out using crude oil treated with 50 ppm of a 50:50 blend of benzene sulfonic acid and isooctyl acid phosphate, as employed in previous examples. The data shown in Table 3 is presented as the change in heat transfer coefficient (Δu).

TABLE III

| Test Time (Minutes) | Δu (Blank) | Δu (Treated) |
|---|---|---|
| 0 | 0 | 0 |
| 10 | 1.05 | 0 |
| 20 | 4.13 | 0 |
| 30 | 6.14 | 0 |
| 40 | 7.79 | 0 |
| 50 | 10.37 | 0.37 |
| 60 | 11.63 | 0.37 |
| 70 | 12.88 | 0.37 |
| 80 | — | 0.37 |
| 90 | — | 0.73 |
| 100 | 16.25 | — |
| 110 | — | 0.73 |
| 130 | 18.33 | 1.09 |
| 150 | 19.80 | — |
| 160 | 19.93 | — |
| 170 | 20.66 | 2.53 |
| 180 | 21.23 | 2.88 |

Example III shows that the antifoulants of the invention significantly improve the fouling characteristics of process equipment in which sour crude is treated.

Although the invention is described with particular reference to specific examples, it it understood that alternate embodiments may be employed. The scope of the invention is limited only by the breadth of the appended claims.

What is claimed is:

1. In a method of inhibiting fouling in petroleum processing equipment during processing of high sulfur feedstocks comprising injecting into a petroleum or petroleum derivative feed stream to said equipment an amount of antifoulant effective to substantially reduce the rate of fouling, the improvement comprising using as the antifoulant the composition comprised of:

(a) 10 to 90 weight percent of at least one phosphorus acid ester selected from

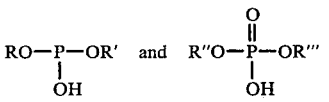

wherein R and R″ are hydrogen or an alkyl group having 1 to 20 carbons and R′ and R‴ are alkyl groups having 1 to 20 carbon atoms, and (b) 90 to 10 percent of at least one hydrocarbon sulfonic acid having 1 to 50 carbon atoms.

2. The improved method of claim 1 wherein the antifoulant composition is injected into the feed stream in a concentration of about 0.5 to 1000 ppm based on the weight of said feed stream.

3. The improved method of claim 2 wherein R and R″ are hydrogen or an alkyl group having 1 to 12 carbon atoms, R′ and R‴ are alkyl groups having 1 to 12 carbon atoms, and the hydrocarbon sulfonic acid is at least one alkyl benzene sulfonic acid having 4 to 14 alkyl carbon atoms.

4. The improved method of claim 2 wherein the compound in (a) is isooctyl acid phosphate and the compound in (b) is dodecyl benzene sulfonic acid.

5. The improved method of any one of claims 1, 13, 14, or 15 wherein the compounds in (a) and (b) are present in amounts of about 25 to 75 parts and 75 to 25 parts by weight, respectively.

6. The improved method of claim 5 wherein the antifoulant is dissolved in an inert organic solvent.

7. The improved method of claim 6 wherein the antifoulant is added to the feed stream at a concentration of about 1 to 100 parts per million parts of feed stream.

* * * * *